US005168122A

United States Patent [19]

Furst et al.

[11] Patent Number: 5,168,122

[45] Date of Patent: Dec. 1, 1992

[54] SAFE-AND-ARM DEVICE

[75] Inventors: Wilhelm Furst, Buchberg; Manfred Klare, Neunkirchen; Norbert Liebl, Ruckersdorf, all of Fed. Rep. of Germany

[73] Assignee: Diehl GmbH & Co., Nuremberg, Fed. Rep. of Germany

[21] Appl. No.: 841,056

[22] Filed: Feb. 25, 1992

[30] Foreign Application Priority Data

Feb. 25, 1991 [DE] Fed. Rep. of Germany ..... 4105829

[51] Int. Cl.[5] ..... F42C 15/40; F42C 14/06; H01H 9/26

[52] U.S. Cl. ..... 102/262; 102/222

[58] Field of Search ..... 102/262, 221, 222, 258, 102/259

[56] References Cited

U.S. PATENT DOCUMENTS

| | | | |
|---|---|---|---|
| H281 | 6/1987 | Munach | 102/262 |
| 2,721,913 | 10/1955 | Kent | 102/262 |
| 3,698,323 | 10/1972 | Apstein et al. | 102/262 |
| 4,675,480 | 6/1987 | Jones | 102/262 |
| 4,727,809 | 3/1988 | Watson | 102/262 |
| 4,727,810 | 3/1988 | Furst et al. | 102/263 |
| 4,953,475 | 9/1990 | Munach et al. | 102/262 |

FOREIGN PATENT DOCUMENTS 3610358 1/1987 Fed. Rep. of Germany .

*Primary Examiner*—David H. Brown

*Attorney, Agent, or Firm*—Scully, Scott, Murphy & Presser

[57] ABSTRACT

A safe-and-arm device with a series connection formed through a switch which is activated through triggering criteria and which is connected ahead of a detonator for a secondary explosive, especially for utilization with a submunition projectile. Hereby, a switching element of a first switch is arranged on a first carrier or support for the switching element which is slidable from its blocked secured or safe position through the intermediary of a power element which is initiated by a releasing criterium into armed position, and a switching element of a second switch is arranged on a support for this switching element which is coupled with the support of the first switching element and displaceable by the latter from its safe position across an interim position into its armed position in the presence of a further releasing criterium.

10 Claims, 2 Drawing Sheets

SAFE-AND-ARM DEVICE

BACKGROUND OF THE INVENTION

1. Field of the Invention

The present invention relates to a safe-and-arm device with a series connection formed through a switch which is activated through triggering criteria and which is connected ahead of a detonator for a secondary explosive, especially for utilization with a submunition projectile. Hereby, a switching element of a first switch is arranged on a first carrier or support for the switching element which is slidable from its blocked secured or safe position through the intermediary of a power element which is initiated by a releasing criterium into armed position, and a switching element of a second switch is arranged on a support for this switching element which is coupled with the support of the first switching element and displaceable by the latter from its safe position across an interim position into its armed position in the presence of a further releasing criterium.

2. Discussion of the Prior Art

A safe-and-arm device of that type is described in the disclosure of U.S. Pat. No. 4,727,810 assigned to the common assignee of the present application. Safety regulations for fuzes permit the implementation of such a safe-and-arm arrangement without any mechanical interruption of an ignition chain, when the detonator employed for the triggering of the charge of the warhead utilizes insensitive or low-responsive explosive mixtures, in essence, secondary explosives. A detonator of this type is activatable through an impactlike or sudden electrical discharge or through an exploding electrical conductor. However, in such a detonator, in compliance with safety regulations there must be afforded that the transition from the safe into the armed condition will only be carried out when there are present at least two environmental criteria (releasing criteria) which are independent of each other and which are significant for the orderly functioning of the ammunition. For this purpose, there are provided the intended switches in series connection ahead of the detonator for the secondary explosive.

In accordance with the disclosure of U.S. Pat. No. 4,727,810, the first switch is activated in dependence upon a submunition ejection command through an electrically triggerable, pyrotechnic power element from an energy storage of the submunition carrier, to the extent that the free-flight conditions of the carrier have led to an adequate charging of an energy accumulator. The first switching element support, however, only moves into its armed position when also the second releasing criteria has been fulfilled. This depends upon the transition of the submunition projectile into its phase of gliding flight The first switching element support in the switching element support are positively coupled together through a follower or engaging member.

SUMMARY OF THE INVENTION

Accordingly, it is an object of the present invention to improve upon a safe-and-arm device of generally the above-mentioned type with respect to its construction and its functioning.

Inventively, the foregoing object is achieved for a safe-and-arm device of the above-mentioned type in that the first switching element support is coupled with the second switching element support through a spring-energy element, which stresses or tensions the first switching element support during transition from its safe position into its armed position, and wherein the second switching element support is supported so as to be slidable in parallel relative to the first switching element support.

Through the energy storage in the form of a spring there is avoided a positive coupling or interconnection between the first switching element support and the second switching element support. As soon as the power element responds, the first switching element support goes its armed position, as a result of which there is closed the first switch. The second switching element support cannot block the first switching element support. Through the parallel-displaceable supporting for the two switching element supports it is possible to obtain a tightly compact assembly for the safe-and-arm device which is correlated with the conditions of available space. The spring energy storage is able to be simply arranged in a simple manner under this condition of parallel displacability. In any case, there is avoided that the second switching element support must be pivotably supported, as in the instance of German DE 36 10 358 C2.

A further advantage of the invention resides in that the functioning of the safe-and-arm arrangement can be carried out simply and that subsequent to a triggering procedure which has been undertaken for test purposes, can be reset in a simple manner. This feature is described in more extensive detail hereinbelow.

In a further inventive modification, a positioning or setting element is associated with the second switching element support, which causes the second switching element support to be blocked in its armed position as well as also in its interim position. Through the blocking in the armed position there is achieved that any kind of accelerating forces encountered after the reaching of the armed position by the second switching element support will not lead to the second switching element support will again leaving its armed position; in effect, that the second switch would be opened. Preferably, the second switching element support hereby blocks the first switching element support which is standing in its armed position.

Due to the blocking of the second switching element support in its intermediate or interim position, which it assumes when the second triggering criteria is not present, when the first triggering criteria is encountered, there is attained that a subsequently encountered occurrence of the second triggering criteria can no longer lead to a closing of the second switch. As a result thereof, this will afford that only then, when the further triggering criteria is present preceding the response of the power element, will there be carried out a triggering of the detonator for the secondary explosive. In the reverse instance, when there is encountered the first triggering criteria; in effect, the power element responds, prior to the presence of the second triggering criteria, then a subsequent occurrence of the further triggering criteria can no longer lead to a triggering or ignition.

The detonator for the secondary explosive which is actuated through the two above-indicated switches, is provided for effectuating a triggering of a charge in the submunition-projectile.

There are also known submunition-projectiles which carry a further active charge. For this charge there is then to be provided a further ignition chain with an auxiliary detonator In one embodiment of the invention, this auxiliary detonator is located on the second switching element support This detonator moves from its secured or safe position into its armed position when the second switching element support moves from its safe position into its armed position. As a consequence, the safe-and-arm device thereby secures both active charges. This significantly reduces the constructional requirements inasmuch as it is not necessary to provide two separate safe-and-arm devices.

BRIEF DESCRIPTION OF THE DRAWINGS

Further advantageous embodiments of the invention can now be more readily ascertained from the following detailed description of exemplary embodiments thereof, taken in conjunction with the accompanying drawings; in which.

DETAILED DESCRIPTION

Figure 1:
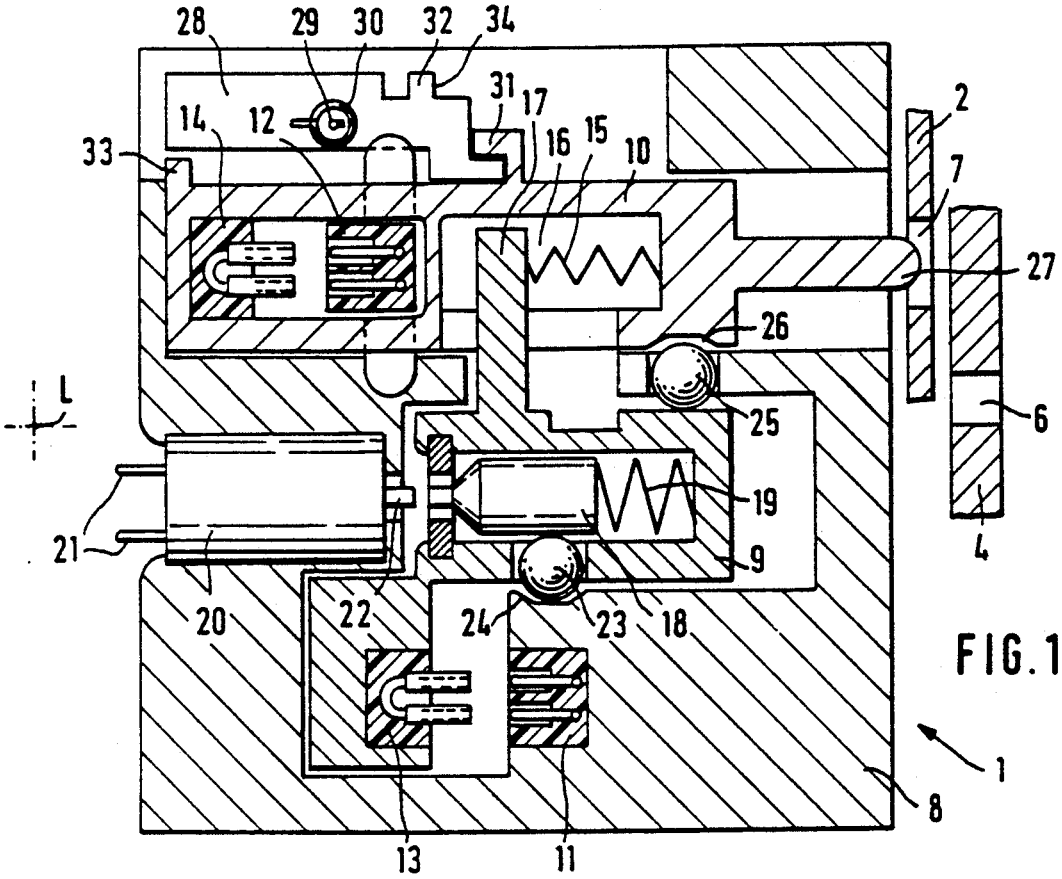
FIG. 1 illustrates, generally schematically, a cross-sectional view through an embodiment of the inventive safe-and-arm device shown in its safe position.

A safe-and-arm device 1 for a submunition-projectile is installable within the cylindrical casing 2 of the latter. Fastened to the casing 2 are a pair of mountings 3 for wings or fins. Moreover, supported on the casing 2 is a ring 4 so as to be rotatable about the longitudinal axis L of the casing through almost 90°, and which carries another pair of mountings 5 for further fins or wings, as shown in FIG. 4.

Figure 3:
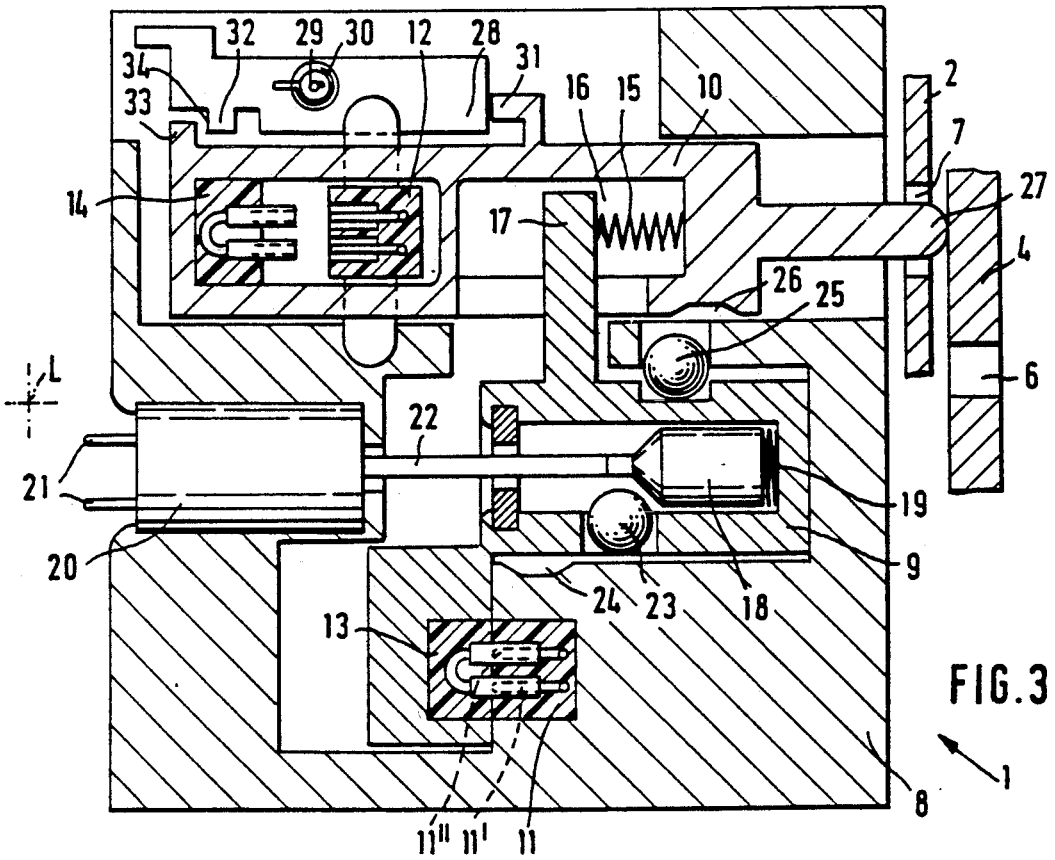
FIG. 3 illustrates a blocked intermediate position for the device of FIG. 1.
Figure 4:
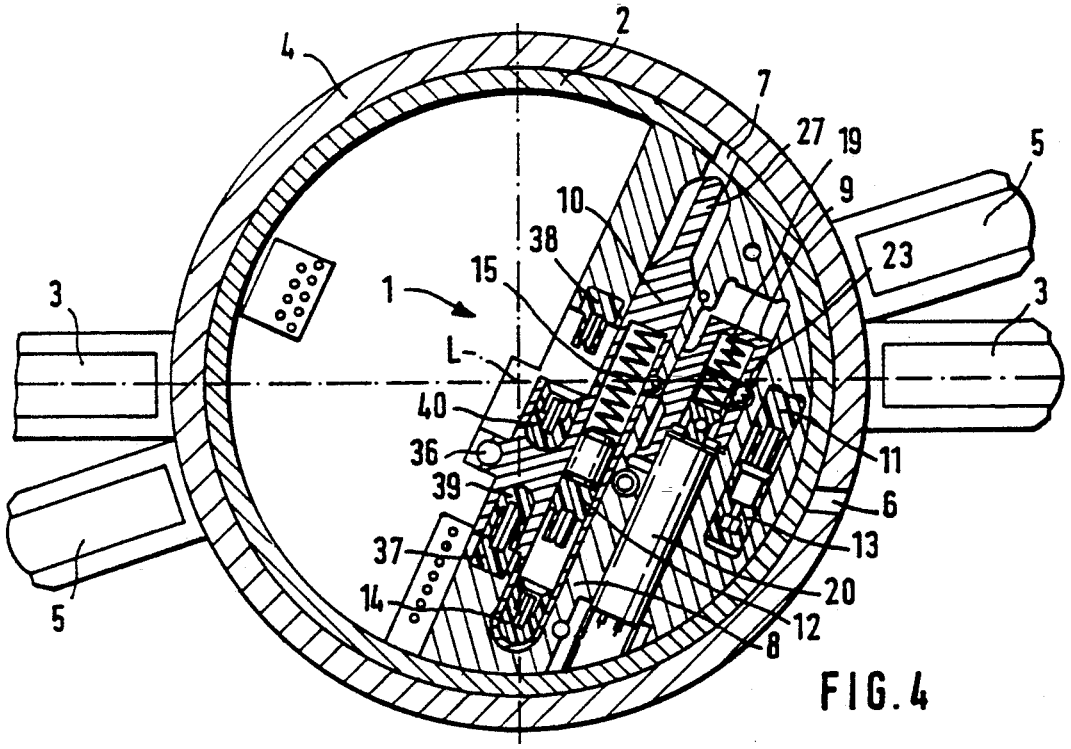
FIG. 4 illustrates an example of an installation of the safe-and-arm device in a submunition-projectile possessing an auxiliary detonator.

In the position of the pairs of mountings 3, 5 in which they are respectively swung together, as illustrated in FIGS. 1, 3 and 4, a plurality of such submunition-projectiles are transported within an airborne body, not shown, and the latter of which forms a carrier for articles of submunition. In compliance with an ejection signal from the submunition-carrier, the submunition projectiles are expelled, and the ring 4 is rotated in such a manner that the mounting pairs 3, 4 stand at an angle of 90° relative to each other. The ring 4 includes a breakthrough 6, which then aligns with a breakthrough 7 in the casing 2.

The safe-and-arm device possesses a base member 8 which is installable in the casing 2. Supported within this base member are a first switching element support 9 and a second switching element support 10 so as to be slidable or displaceable in parallel relative to each other. The directions of displacement are hereby located in planes which extend perpendicular to the longitudinal axis L, such that any accelerations or decelerations acting along the direction of the longitudinal axis L can hardly exert any effect on the switching element supports 9, 10.

In the base member 8 there is fastened a first contact socket or base 11 and a second contact socket or base 12. Arranged in the first switching element support 9 is a first switching element 13 as a short circuit-plug or jumper for the contact socket 11. Arranged in the second switching element support 10 is a second switching element 14 as a short circuit-plug for the second contact socket 12.

The first contact socket 11 and the first switching element 13 form the first switch. The second contact socket 12 and the second switching element 14 form the second switch. These two switches are connected electrically in series with a detonator for a secondary explosive, which is not described in detail as being known from the disclosure of U.S. Pat. No. 4,727,810. This detonator responds when the switching element 13, as well as the switching element 14, short-circuit the electrical contacts 11', 11'' or, 12', 12'', of the contact socket 11 or 12.

The first switching element support 9 and the second switching element support 10 are stored with each other through a spring-energy element 15. Hereby, the spring element 15 is a compression spring 15 which is arranged in the interior space 16 of the second switching element support 10, wherein the spring, on the one hand, supports itself in this support and, on the other hand, against a projection 17 on the first switching element support 9 extending into the interior space 16.

Supported within the first switching element support 9 is a transmitting pin 18 so as to be displaceable in parallel with the direction of effectiveness of the switching element support 9. The transmitting pin 18 supports itself by means of a further spring-energy element 19, which is similarly constituted from a compression spring, within the first switching element support 9.

For the actuation of the transmitting pin 18 there is provided a power element 20 which is electrically activatable through contacts 21, and in response to such an actuation, exerts a force against the transmitting pin 18 through the intermediary of a pusher rod or striker 22.

A roll member formed by a ball 23 is supported in the switching element support 9, so as to cooperate with the transmitting pin 18. The ball 23 is pressed by the transmitting pin 18 in the safe position into a recess 24 provided in the base member 8, as is shown in FIG. 1. As a result thereof, the first switching element support 9 is blocked relative to the base member 8.

As a further roll member, there is supported a further ball 25 in the base member 8. This ball 25, in the safe position, engages into a recess 26 in the second switching element support 10, wherein the ball supports itself against the first switching element support 9.

The second switching element support 10 possesses a scanning finger or feeler 27 which is associated with the breakthroughs 7, 6. The second switching element support 10 is provided with a positioning element 28. This element is pivotable about an axis 29, and subjected to the force of a spring 30 for rotation about this axis 29. The axis 29 extends perpendicular to the direction of displacement for the switching element supports 9, 10.

The positioning element 28 is retained in the safe position, as shown in FIG. 1, by means of an angle member 31 of the second switching element support 10 in opposition the force of the spring 30.

The positioning element 28 possesses a limit stop region 32, which has associated therewith a complementary limit stop 33 on the second switching element support 10. The association therebetween is configured in such a manner that during the operative cooperation between the limit stop region 32 and the complementary stop 33, the second switching element support is blocked in its armed position; referring to FIG. 2.

Moreover, a further stop 34 is provided on the positioning element 28. This stop ensures, in operative cooperation with the complementary stop 33, that the second switching element support 10, after a delayed encountered turning of the ring 4, can only move into an intermediate position.

Figure 2:
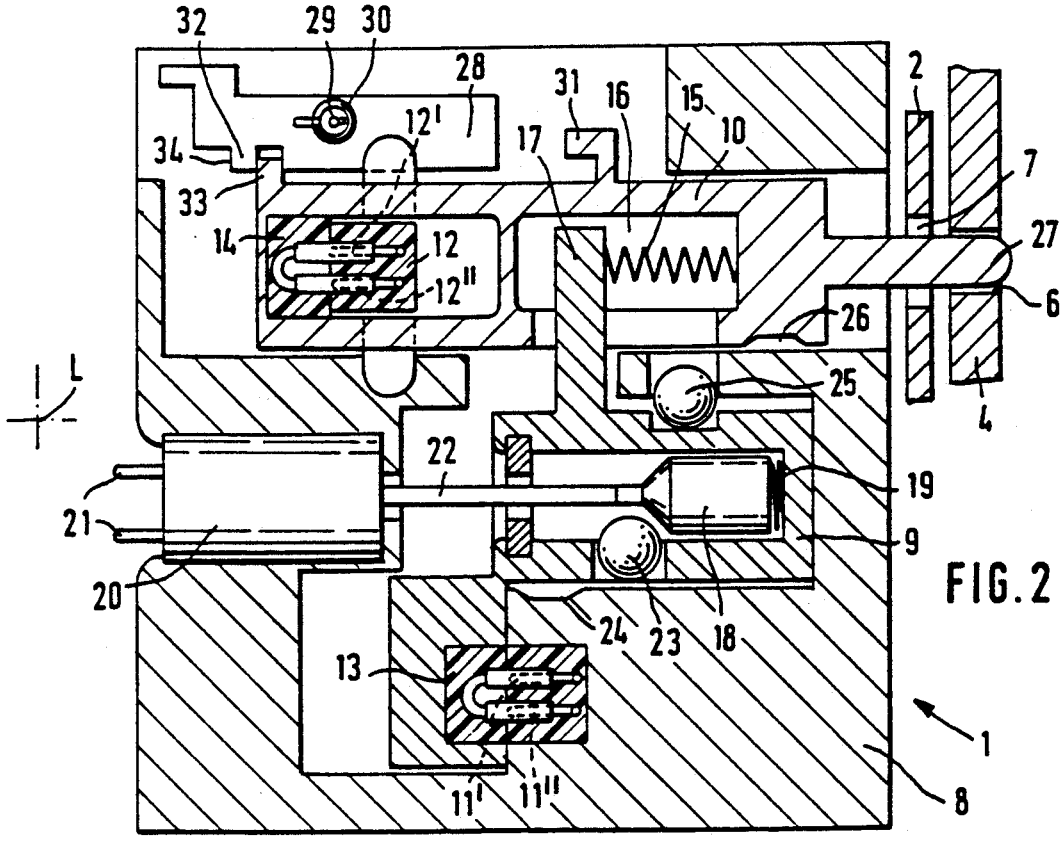
FIG. 2 illustrates a view similar to FIG. 1 showing the device in its armed position.

The operational readiness of the safe-and-arm device can be simply tested without requiring any release of the power element 20. For this purpose, while bypassing the power element 20 or, in essence, prior to its installation in the base number 8, pressure is exerted against the transmitting pin 18. As a result, this pin releases the ball 23 and compresses the further spring-energy element 19. This provides the consequence of imparting a displacement to the switching element support 9. Due to this displacement the spring-energy element 15 is compressed and the further ball 25 is released. In consequence of the foregoing, the second switching element support 10 will shift itself. Inasmuch as its scanning finger 27 will not be obstructed by the ring 4 during the testing phase, since it is not installed in the submunition during the testing phase, the second switching element support 10 then comes into its position as is illustrated in FIG. 2. Prior to the reaching of this position, the positioning element 28 releases itself from its restraint by the angle member 31, and under the action of the spring 30 pivots in a direction of blocking the second switching element support 10 at the complementary stop 33. The positioning element 28 is easily engageable during the operational testing, so that its limit stops 34 can be simply placed out of force.

After the functions of the safe-and-arm device have been tested, the latter allows itself to be easily reset. For this purpose, pressure is exerted against the scanning finger 27, in accordance with FIGS. 1 through 3, towards the left. Upon occasion, the positioning element 28 is pivoted opposite the force of the spring 30, so that the positioning element 28 will not obstruct the resetting.

During the installation of the safe-and-arm device 11 into the casing 2, the scanning finger 27 forms an installation safety. This is because when the scanning finger 27 as a result of an engagement of the switching element 14 in the contact member 12 projects extensively beyond the casing 2, there is no longer present an installation possibility.

When the safe-and-arm device is installed in the submunition projectile, there is obtained the following function:

In the event the submunition projectile is expelled from the carrier, then the ring 4 rotates about the longitudinal axis L so that the breakthrough 6 comes into alignment with the breakthrough 7. When the power element 20 thereafter responds, as is usually the case, which acts after a delay in time pursuant to an electrical recharging, the pusher 22 then acts against the transmitting pin 18, so that the latter releases the ball 23 and compresses the further spring-energy element 19. This has the result that the spring-energy element 15 is compressed and it displaces the second switching element support 14 whereby there is simultaneously released the ball 25. In correspondence therewith, the scanning finger 27 slides through the breakthroughs 7, 8; wherein the positioning element 28 releases itself from the angle member 31 and with its stop 32 engages over the limit stop region 33. Both switches are now in the armed position.

In the event that, because of any kind of reasons, the release is carried out in a false sequence, in that the breakthrough 6 in the ring 4 is not yet aligned with the breakthrough 7 in the casing 2, then the positioning element is still released, so that it is pivoted by means of its spring 30. However, the stop 34 for the complementary stop 33 of the second switching element support 10 now produces a blocking effect. This prevents any contacting of the second switching element 14 with the associated contact socket 12, so that the detonator for the secondary explosive cannot be activated.

Accordingly, there is provided assurance that, in the event of a reversed sequence being encountered, the second switching element support 10 will be released; however, nevertheless it cannot lead to an activation of the switch which is associated therewith.

In the exemplary embodiment pursuant to FIG. 4, an additional detonator 36 is arranged on the second switching element support 10. This is a component of a further ignition chain, not shown herein. For this chain there are provided on the base member 8 two further contact bases or sockets 37, 38, which have further short-circuit plugs 39, 40 associated therewith as switching elements, referring to FIG. 4. These are fastened on the second switching element support 10.

In the safe position of the second switching element support 10, the additional detonator 36 stands in its secured position and the short-circuit plug 39 engages into the contact socket 37. When the second switching element support 10 in its armed position is moved in the direction of the arrow S into its armed position, then the additional detonator 36 is similarly moved into its armed position Hereby, the short-circuit plug 39 separates itself from the contact socket 37, and the short-circuit plug 40 engages into the contact socket 38.

What is claimed is:

1. Safe-and-arm device for a submunition-projectile, said device including a series-connected circuit with switches activated by releasing criteria, a power element operatively connected with said support for causing said support to slide from a block safe position into an armed position responsive to said power element having activated by a releasing criteria; a second said switch having a switching element located on a second switching- element support, means coupling said first switching element support with said first switching element support said second support being displaceable from a safe position through an intermediate position into an armed position by said first switching element support upon the occurrence of a second releasing criteria, said coupling means including a spring-energy element coupling said first switching element support with the second switching element support so as to be displaceable in parallel relative to said first switching element support.

2. Safe-and-arm device as claimed in claim 1, wherein a scanning finger is located on said second switching element, said finger being operatively associated with a component which is dependent upon the position of flight embodying the second releasing criterium.

3. A safe-and-arm device as claimed in claim 1, wherein a detonator is arranged on said second switching element support, said detonator being displaced from a safe position into an armed position responsive to said second switching element support being displaced from a safe position into an armed position.

4. Safe-and-arm device as claimed in claim 3, wherein short-circuit plugs for the ignition train of said detonator are located on said second switching element support.

5. Safe-and-arm device as claimed in claim 1, wherein a positioning element is operatively associated with said second switching element support, said second switching element support being blockable in its armed position and in an intermediate position thereof by said positioning element.

6. Safe-and-arm device as claimed in claim 5, wherein means block said positioning element in the secured position of the second switching element support against said support, and upon said support leaving the safe position, prior to reaching the intermediate position, said means releasing said positioning element and blocking the second switching element support in the safe position or intermediate position thereof.

7. Safe-and-arm device as claimed in claim 5, wherein said positioning element is pivotable about an axis responsive to the biasing force of a spring.

8. Safe-and-arm device as claimed in claim 1, wherein said power element acts on the first switching element support through a transmitting pin and a further spring-energy element, said transmitting pin responsive to being acted upon by the power element releasing a roll member arresting said first switching element support.

9. Safe-and-arm device as claimed in claim 8, wherein said second switching element support is blocked in the safe position thereof by a second roll member which releases said first switching element support during transition thereof into its armed position.

10. Safe-and-arm device as claimed in claim 9, wherein said second switching element support which is blocked in the armed position blocks the first switching element support which is in its armed position.

* * * * *

UNITED STATES PATENT AND TRADEMARK OFFICE

CERTIFICATE OF CORRECTION

PATENT NO. : 5,168,122

DATED : December 1, 1992

INVENTOR(S) : Wilhelm Furst, et al.

It is certified that error appears in the above-identified patent and that said Letters Patent is hereby corrected as shown below:

Column 1, line 56: after "flight" insert --.--

Column 6, line 37, Claim 1: after "criteria" insert --a first said switch having a switching element of the first switch located on a first switching element support--

Column 6, line 41, Claim 1: "having" should read as --being--

Signed and Sealed this

Twenty-eighth Day of December, 1993

Bruce Lehman

*Attest:*

BRUCE LEHMAN

*Attesting Officer*

*Commissioner of Patents and Trademarks*